US008615183B2

(12) United States Patent
Nagasaki

(10) Patent No.: US 8,615,183 B2
(45) Date of Patent: Dec. 24, 2013

(54) SHEET CONVEYING APPARATUS AND IMAGE FORMING APPARATUS

(75) Inventor: Tsuyoshi Nagasaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 367 days.

(21) Appl. No.: 13/023,831

(22) Filed: Feb. 9, 2011

(65) Prior Publication Data

US 2011/0211887 A1 Sep. 1, 2011

(30) Foreign Application Priority Data

Feb. 26, 2010 (JP) ..... 2010-042838

(51) Int. Cl.
*G03G 21/00* (2006.01)

(52) U.S. Cl.
USPC ..... 399/99; 399/34

(58) Field of Classification Search
USPC ..... 399/99
See application file for complete search history.

(56) References Cited

U.S. PATENT DOCUMENTS 4,013,359 A * 3/1977 DuBois et al. ..... 399/398
4,755,252 A * 7/1988 Held ..... 156/389
5,732,315 A * 3/1998 Inoue et al. ..... 399/317
5,854,963 A * 12/1998 Hehn ..... 399/345
6,406,549 B1 * 6/2002 Berg et al. ..... 134/1
7,933,546 B2 * 4/2011 Fukao et al. ..... 399/346
8,052,246 B2 * 11/2011 Yamamoto ..... 347/22
2005/0251976 A1 * 11/2005 Lipponen et al. ..... 28/100
2008/0031669 A1 * 2/2008 Takei ..... 399/397

FOREIGN PATENT DOCUMENTS

JP 2006-131375 5/2006

* cited by examiner

*Primary Examiner* — Anthony Nguyen

(74) *Attorney, Agent, or Firm* — Fitzpatrick, Cella, Harper & Scinto

(57) ABSTRACT

A cleaning brush is not made slidably contact suctioning endless belts which pass inlets, and the cleaning brush is made slidably contact non-suctioning endless belts which do not pass the inlets. Consequently, it is possible to bring out paper dust and transfer remaining toner which adhere to the suctioning endless belts in attracting areas in which the inlet holes are formed, to the exterior of the apparatus by means of sheets to be conveyed. By contrast with this, from non-suctioning endless belts, the cleaning brush can clean and remove paper dust and transfer remaining toner which adhere to the non-suctioning endless belts.

10 Claims, 7 Drawing Sheets

A; BELT SURFACES ARE COATED

B; BELT SURFACES ARE NATURAL SURFACES

SHEET CONVEYING APPARATUS AND IMAGE FORMING APPARATUS

BACKGROUND OF THE INVENTION

1. Field of the Invention

The present invention relates to an image forming apparatus such as a copying machine or printer of an electrophotographic system, and, more particularly, to a sheet conveying apparatus and an image forming apparatus having this sheet conveying apparatus of a suctioning-conveying system using endless conveying belts.

2. Description of the Related Art

Recently, image forming apparatuses such as copying machines, printers and facsimile machines using an electrophotographic system are spreading. Further, these image forming apparatuses are required to output all sheets such as thin paper, thick paper and coated paper while maintaining high productivity (a number of sheets to form images per unit time), and, moreover, provide durability for maintaining quality in a long term of use.

Incidentally, in a sheet conveying portion, paper dust (sheet dust) is produced from sheets when rollers or guides which convey the sheets contact sheets. Further, with the electrophotographic system image forming apparatuses, part of toner used to form images remains in a photoreceptor (this is referred to as "transfer remaining toner"), and this transfer remaining toner flies before it is cleaned. Furthermore, there are cases where such paper dust and transfer remaining toner accumulate in sheet conveying portions which convey sheets to which toner is transferred, and the paper dust and transfer remaining toner additionally accumulated adhere to sheets to be conveyed and are heated and pressured by a fixing apparatus, thereby causing a problem that quality of images becomes poor. In addition, if paper dust and transfer remaining toner which adhere to sheets are little, image quality does not become poor even when the sheets are heated and pressured by the fixing apparatus. However, image quality becomes poor when a great amount of accumulated paper dust and transfer remaining toner collectively adhere to sheets at one time.

To solve this problem, a sheet conveying apparatus is proposed which is configured to make a cleaning member, which cleans sheet conveying surfaces of endless belts, slidably contact belt surfaces of the conveying belts. This technique is disclosed in Japanese Patent Laid-open No. 2006-131375.

With a conventional sheet conveying apparatus which cleans conveying belts using a cleaning member, the cleaning member slidably contacts the belt surfaces of the conveying belts at all times. Therefore, the belt surfaces of the conveying belts gradually become rough due to friction with the cleaning member in a long period of use and significant unevenness is formed. A great amount of paper dust and transfer remaining toner accumulate in the uneven portions, and therefore the cleaning member cannot sufficiently clean the sheet conveying surfaces. Particularly, with a configuration of a suctioning-conveying system of attracting a sheet to sheet conveying surfaces by applying negative pressure of air to conveying belts and conveying the sheet, a plurality of inlet holes for suctioning air is formed in the conveying belts, and therefore corner portions of the inlet holes are scraped and a great amount of paper dust and transfer remaining toner accumulate in these scraped portions. Further, contact pressure between the conveying belts and a sheet increases because the sheet is suctioned by means of negative pressure, and a great amount of paper dust and transfer remaining toner is likely to adhere to sheets collectively. Hence, the above problem that image quality becomes poor cannot be solved reliably even if a cleaning member is used.

SUMMARY OF THE INVENTION

The present invention provides a sheet conveying apparatus and an image forming apparatus having this sheet conveying apparatus which can prevent image quality from becoming poor by reducing a great amount of paper dust and transfer remaining toner adhered to sheets without decreasing cleaning performance of a cleaning member which cleans conveying belts of a suctioning-conveying system.

According to the present invention, in the sheet conveying apparatus which has, an attracting and conveying portion which attracts and conveys a sheet, the attracting and conveying portion comprising, an conveying belt portion which attracts the sheet to a sheet conveying surface by negative pressure of air and conveys the sheet, and a cleaning member which contacts and cleans a belt surface of the conveying belt portion, wherein an attracting area which attracts the sheet to the sheet conveying surface is set on an inner side of a range in a width direction orthogonal to a conveying direction in a minimum size sheet which can be conveyed by the attracting and conveying portion, and the cleaning member is arranged to contact the belt surface outside the attracting area.

Further features of the present invention will become apparent from the following description of exemplary embodiments with reference to the attached drawings.

DESCRIPTION OF THE EMBODIMENTS

Figure 1:
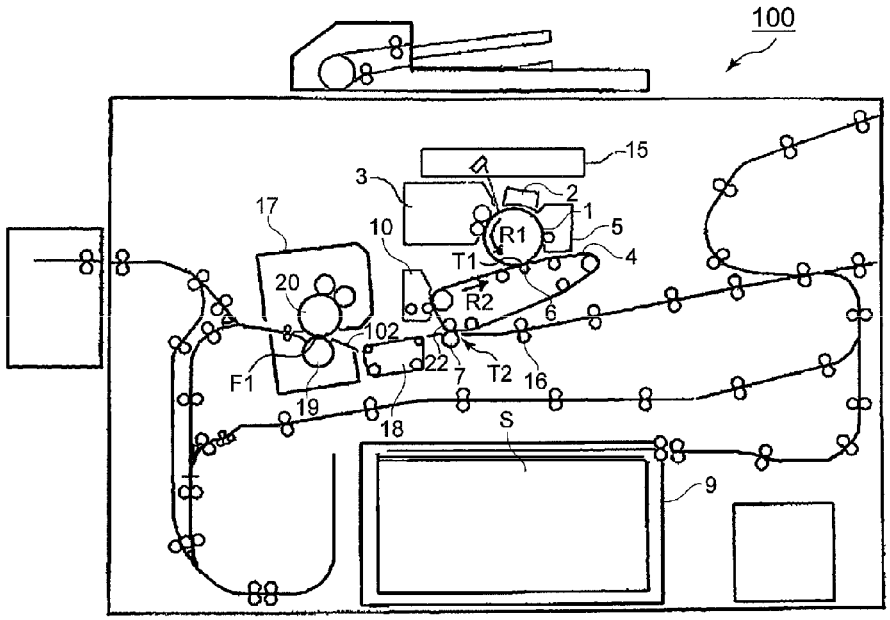
FIG. 1 is a cross-sectional view illustrating a schematic configuration of an image forming apparatus according to the present invention.

An embodiment according to the present invention will be described below referring to FIGS. 1 to 7. FIG. 1 is a cross-sectional view illustrating a schematic configuration of an image forming apparatus 100 according to the present invention.

As illustrated in FIG. 1, this image forming apparatus 100 is formed with a high-speed black and white printer in which a photosensitive drum 1 of a black developing color is arranged along an intermediate transfer belt 4 provided in the central portion in the image forming apparatus main body. Around the photosensitive drum 1, a corona charger 2, an exposure apparatus 15, a developing apparatus 3, a primary transfer roller 6, and a toner collecting apparatus 5 are arranged.

The photosensitive drum 1 is formed with a metallic cylinder on the surface of which a photosensitive layer of a negative charge polarity is formed, and rotates in the direction of an arrow R1. A black toner image formed on the photosensitive drum 1 is primarily transferred by a primary transfer portion T1 to an intermediate transfer belt 4 which rotates and moves in the direction of an arrow R2, and conveyed to a secondary transfer portion T2 by the intermediate transfer belt 4 and secondarily transferred to a sheet S.

In a sheet deck 9 arranged in the lower portion of the image forming apparatus main body, a plurality of sheets S is stored and stacked. The sheets S are sent one by one from the sheet deck 9, wait at a registration roller 16 positioned below the intermediate transfer belt 4 and are sent to the secondary transfer portion T2 according to the timing of the toner image on the intermediate transfer belt 4. Then, the sheet S to which the toner image is secondarily transferred in the secondary transfer portion T2 is delivered from the secondary transfer portion T2 to a fixing apparatus 17 by a sheet conveying apparatus 18 which is a pre-fixing conveying portion using belts having a shape without ends (endless belts). The sheet S delivered to the fixing apparatus 17 is heated and pressured in a fixing nip portion F1 formed with a pressure roller 19 and fixing roller 20 inside the fixing apparatus 17. The toner image is fixed the toner image on the sheet surface, and then the sheet S is discharged to the exterior of the image forming apparatus main body.

In addition, an image forming portion which forms images includes the above photosensitive drum 1, exposure apparatus 15, developing apparatus 3, primary transfer roller 6 and intermediate transfer belt 4. The above secondary transfer portion T2 forms a transfer portion which transfers to a sheet a toner image formed as an image by the image forming portion.

Figure 2:
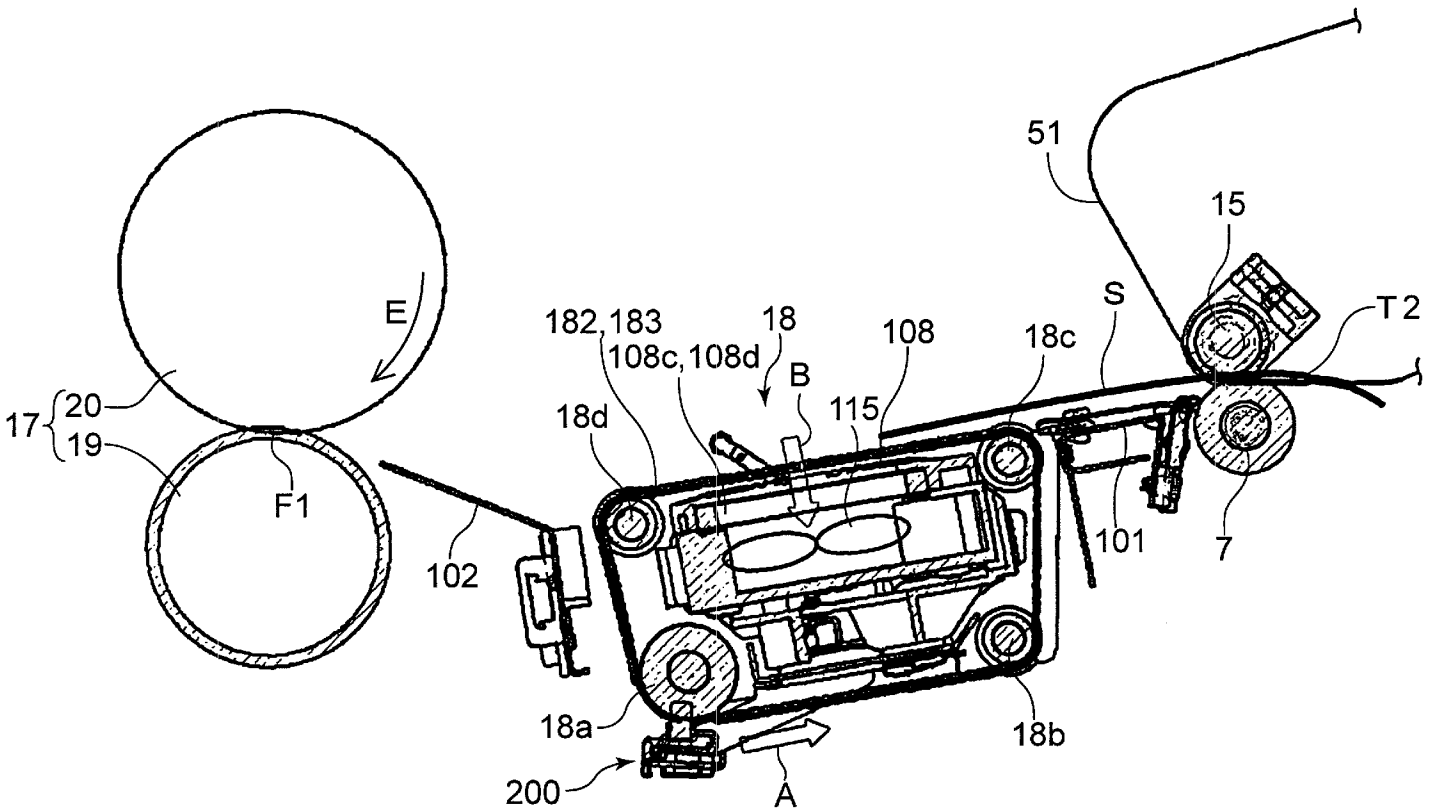
FIG. 2 is a cross-sectional view illustrating a sheet conveying apparatus and its relevant units according to an embodiment of the present invention.
Figure 3:
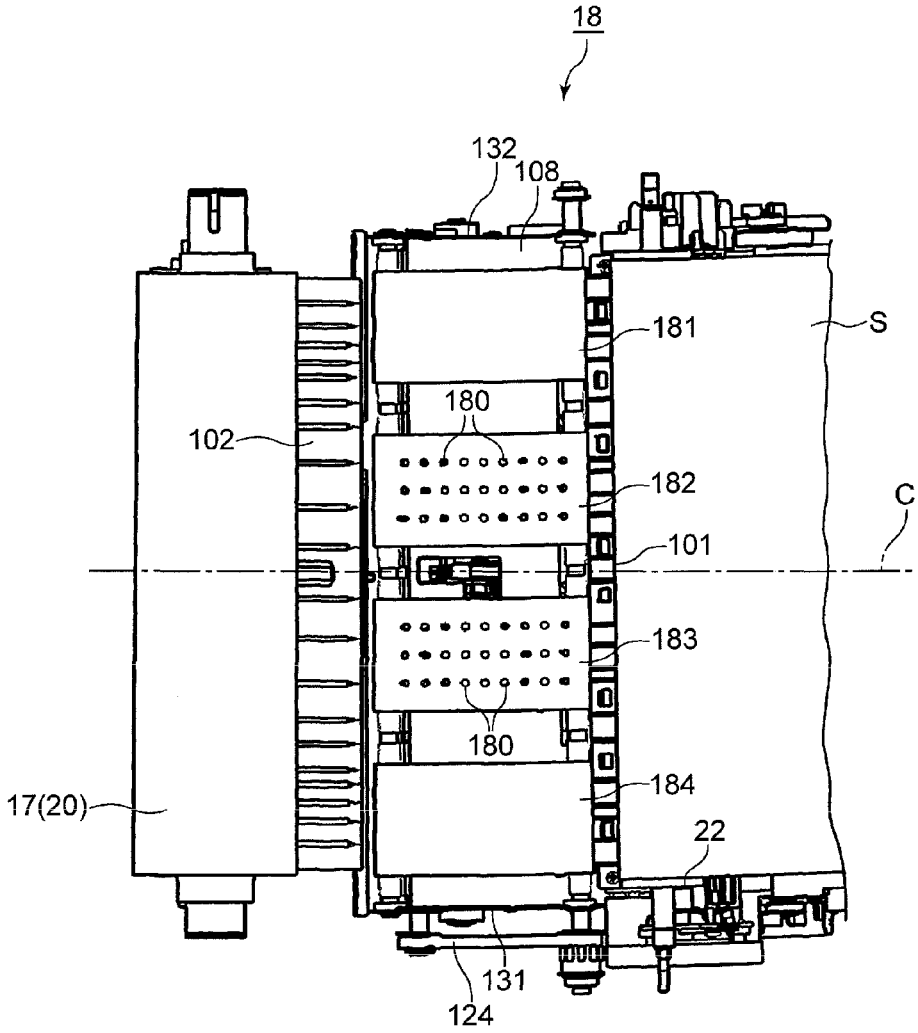
FIG. 3 is a plan view illustrating a sheet conveying apparatus and its relevant units according to the present embodiment.
Figure 4:
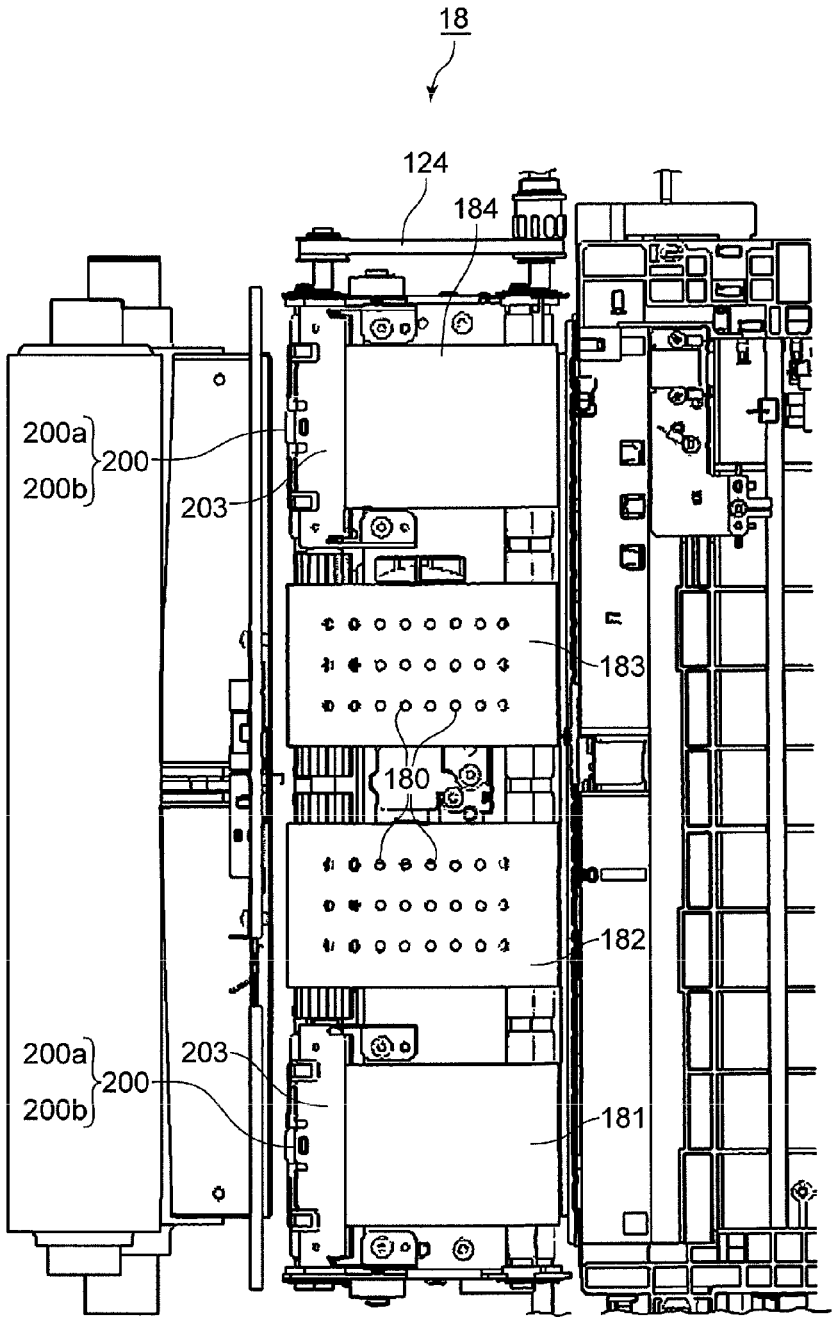
FIG. 4 is a bottom view illustrating a sheet conveying apparatus and its relevant units according to the present embodiment.

FIGS. 2, 3 and 4 are a front view, a plan view and a bottom view, respectively, illustrating the sheet conveying apparatus 18 and its relevant configurations according to the present embodiment.

The sheet conveying apparatus 18 has an attracting and conveying portion which conveys a sheet on which a toner image is transferred by the secondary transfer portion T2 of a transfer portion. As illustrated in FIGS. 2 to 4, with the attracting and conveying portion of the sheet conveying apparatus 18, four rollers of a drive roller 18*a*, driven rollers 18*b* and 18*d* and a rocking roller 18*c* in total are each supported rotatably in a front side plate 131 and a rear side plate 132 supported by a convey frame 108. On the rollers 18*a* to 18*d*, suctioning endless belts 182 and 183 in which a plurality of inlet holes 180 of penetrated round holes is formed, and non-suctioning endless belts 181 and 184 in which the inlet holes 180 are not formed, are stretched respectively. The suctioning endless belts 182 and 183 and non-suctioning endless belts 181 and 184 consist of the conveying belt portion. These non-suctioning endless belts 181 and 184 and suctioning endless belts 182 and 183 form endless conveying belts which convey sheets on the sheet conveying surfaces (conveying belt upper surfaces). In addition, the sheet to be conveyed is conveyed by aligning the center of a conveying path width direction and the center of a sheet width direction, that is, is conveyed according to a so-called center guide. That is, the sheet is conveyed by aligning the center of the sheet width direction to a convey central line C in FIG. 3.

Inside the convey frame 108 and on the inner side of the suctioning endless belts 182 and 183 (lower portion of the interior) on the projection plane from the sheet conveying upper direction, the suctioning fan 115 is disposed. The sheet conveying apparatus 18 produces negative pressure in the convey frame 108 by means of rotation of the suctioning fan 115, and generates attracting force in attracting areas described later by generating the difference in pressure between the sheet conveying surfaces and their back surfaces via a plurality of inlet holes 180. By this means, the sheet conveying apparatus 18 suctions the sheets S in the direction of an arrow B in FIG. 2 via a plurality of inlet holes 180 of the suctioning endless belts 182 and 183, and conveys the sheets S in a state where the sheets S are attracted to the suctioning endless belts 182 and 183.

With the non-suctioning endless belts 181 and 184 and suctioning endless belts 182 and 183, the driving force from a driving motor (not illustrated) disposed on the front side plate 131 of the image forming apparatus main body is transmitted sequentially from a transmission belt 124 to the drive roller 18*a*. By this means, accompanying rotation of the drive roller 18*a*, the endless belts 181 and 184 rotate in the direction of an arrow A in FIG. 2, and conveys the sheets S. In addition, although an idler pulley is disposed in the rocking roller 18*c*, this idler pulley is rotatable with respect to the rocking roller 18*c*.

The suctioning endless belts 182 and 183 are arranged as a pair of belts which are parallel in the width direction orthogonal to the sheet S conveying direction. The non-suctioning endless belts 181 and 184 are arranged as a pair of belts which are parallel on the outer side of each of the suctioning endless belts 182 and 183 in the width direction orthogonal to the sheet S conveying direction.

The non-suctioning endless belts 181 and 184 arranged on the outer side of each of the suctioning endless belts 182 and 183 in the width direction orthogonal to the sheet conveying direction do not convey the sheets S by attracting the sheets S, and functions subsidiarily without the inlet holes 180. The positions of the non-suctioning endless belts 181 and 184 in the width direction orthogonal to the sheet conveying direction are arranged such that their ends in the width direction orthogonal to the sheet conveying direction of all sheets which can be conveyed are positioned so as not to contact the front side plate 131 and rear side plate 132 of the convey frame 108. By this means, it is possible to prevent sheets from contacting and scraping the mold convey frame 108, and prevent sheets from hitting the scraped portion of the convey frame 108 and causing failure to convey the sheets.

The convey frame 108 is configured to be longer than the entire width dimension ranging from the non-suctioning endless belt 181 to the non-suctioning endless belt 184, in the width direction orthogonal to the sheet conveying direction. The convey frame 108 supports each end of the drive roller 18*a*, driven rollers 18*b* and 18*d* and rocking roller 18*c* by the front side plate 131 and rear side plate 132 provided in both ends of the convey frame 108. The convey frame 108 has duct portions 108*c* and 108*d* each accommodating the suctioning fan 115 and having suctioning ports 108*a* and 108*b* for suctioning air. With the convey frame 108, these suctioning ports 108*a* and 108*b* are provided by being positioned on the inner side of each of the suctioning endless belts 182 and 183. That is, the sheet conveying apparatus 18 has the suctioning ports 108*a* and 108*b* to set the attracting areas for attracting sheets to the sheet conveying surfaces, on the inner side of the range of the width direction orthogonal to the conveying direction in which the sheets S of the minimum size which can be conveyed on the sheet conveying surfaces are conveyed. This is because, when the suctioning ports 108*a* and 108*b* protrude beyond the minimum size to the outer side in the width direction, air is suctioned from this portion and sufficient negative pressure cannot be acquired, thereby causing failure of attraction. Particularly, small size sheets include many types of high rigidity such as postcards and envelopes, and, if sheets are not sufficiently attracted while being delivered to a fixing entrance guide 102 described later, the sheets float, thereby causing failure to convey the sheets.

An air suctioning portion which generates attracting force in attracting areas provided on the sheet conveying surfaces on which the sheets S can be attracted (areas in which a plurality of inlet holes 180 is formed in the range of the size H1 in the width direction) includes the suctioning fan 115 accommodated in the duct portions 108*c* and 108*d*. That is, with the suctioning endless belts 182 and 183, the above attracting areas are provided (set) to oppose the suctioning ports 108*a* and 108*b* of the above air suctioning portion in the width direction orthogonal to the sheet S conveying direction.

Further, the non-suctioning endless belts 181 and 184 are configured to rotate and move in the direction of the arrow A in FIG. 2 at virtually the same velocity as the suctioning endless belts 182 and 183. By this means, it is possible to prevent the ends (lateral ends) of the sheets S to be suctioned and conveyed, from slidably contacting and scraping the non-suctioning endless belts 181 and 184, and prevent the sheets from hitting the scraped portions and causing failure to convey the sheets. In addition, the sheet conveying surfaces of the suctioning endless belts 182 and 183 contain a fluorine material, and improves demoldability against dust such as paper dust and transfer remaining toner.

Figure 5:
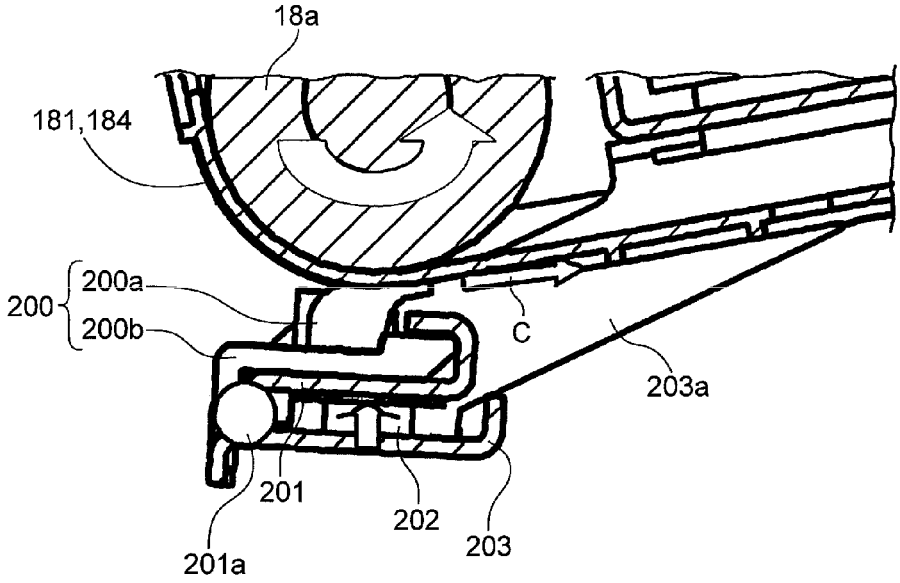
FIG. 5 is a view illustrating in details a cleaning brush unit according to the present embodiment.

Next, a cleaning configuration of cleaning the sheet conveying surfaces of the non-suctioning endless belts 181 and 184 will be described referring to FIGS. 2, 4 and 5. FIG. 5 is a view illustrating a cleaning brush unit 200 in the sheet conveying apparatus 18 in detail.

As illustrated in FIGS. 2 and 4, the cleaning brush unit 200 is arranged on the belt surfaces in the front side lower portions of the non-suctioning endless belts 181 and 184 in the sheet conveying apparatus 18. A cleaning brush 200*a* of the cleaning brush unit 200 forms a cleaning member which contacts the belt surfaces and cleans the sheet conveying surfaces, and is arranged to abut only on the non-suctioning endless belts 181 and 184 (outside the attracting areas) for the reason described below.

As illustrated in FIG. 5, the cleaning brush unit 200 includes the cleaning brush 200*a* and a stay 200*b* which holds the cleaning brush 200*a*. The cleaning brush unit 200 is detachably attached to the sheet conveying apparatus 18 to perform maintenance such as cleaning of paper dust and transfer remaining toner adhered to the cleaning brush 200*a* of the cleaning member.

A cleaning support member 203*a* is attached to the convey frame 108 in the position where the cleaning support member 203*a* does not contact non-suctioning endless belts 181 and 184 respectively, and a cleaning frame 203 is fixed to the convey frame 108 via this cleaning support member 203*a*. The cleaning frame 203 is attached to the lower portion of the cleaning support member 203*a*, and a brush pressure stay 201 is supported by this cleaning frame 203 via a brush pressure stay rotating shaft 201*a*. A pressure spring 202 is installed in a compressed state between the brush pressure stay 201 and cleaning frame 203. The cleaning brush 200*a* is attached to the brush pressure stay 201 via the stay 200*b*.

Therefore, force is applied by the pressure spring 202 to the brush pressure stay 201 to rotate around the brush pressure stay rotating shaft 201*a* toward the non-suctioning endless belts 181 and 184, thereby making the cleaning brush 200*a* abut on the sheet conveying surfaces of the non-suctioning endless belts 181 and 184. Then, when the drive roller 18*a* rotates, the front end of the cleaning brush 200*a* falls down toward the direction of an arrow C in FIG. 5.

As described above, the cleaning brush 200*a* of the cleaning member is arranged to slidably contact the belt surfaces of the non-suctioning endless belts 181 and 184 which are belt portions of the conveying belts according to the present invention corresponding to the sheet conveying surfaces outside the attracting areas. In the non-suctioning endless belts 181 and 184 which are the belt surfaces (belt portions) of the convey belt corresponding to the sheet conveying surfaces outside the attracting areas which the cleaning brush 200*a* slidably contacts, the inlet holes 180 are not formed as described above.

Further, as illustrated in FIG. 2, in the upstream of the conveying direction of the sheet conveying apparatus 18, a transfer nip portion of the secondary transfer portion T2 formed with the secondary transfer roller 22, intermediate transfer belt (ITB) 4 and secondary transfer roller 7 is arranged, and this transfer nip portion nips and conveys the sheets S. Then, a secondary transfer exit guide 101 is attached to the image forming apparatus main body between the sheet conveying apparatus 18 and secondary transfer portion T2 to stabilize sheet conveying movement of the sheets S having passed the transfer nip portion of the secondary transfer portion T2.

Further, in the downstream of the conveying direction of the sheet conveying apparatus 18, the fixing apparatus 17 is disposed with respect to the image forming apparatus main body. With this fixing apparatus 17, the fixing roller 20 and pressure roller 19 form a fixing nip portion F1. When receiving the driving force from the fixing motor (not illustrated) and rotating in the direction of an arrow E in FIG. 2, the fixing roller 20 conveys the sheets S while nipping the sheets S. Further, the fixing entrance guide 102 is disposed between the fixing apparatus 17 and sheet conveying apparatus 18 to stabilize the movement of the sheets S entering the fixing nip portion F1.

Figure 6:
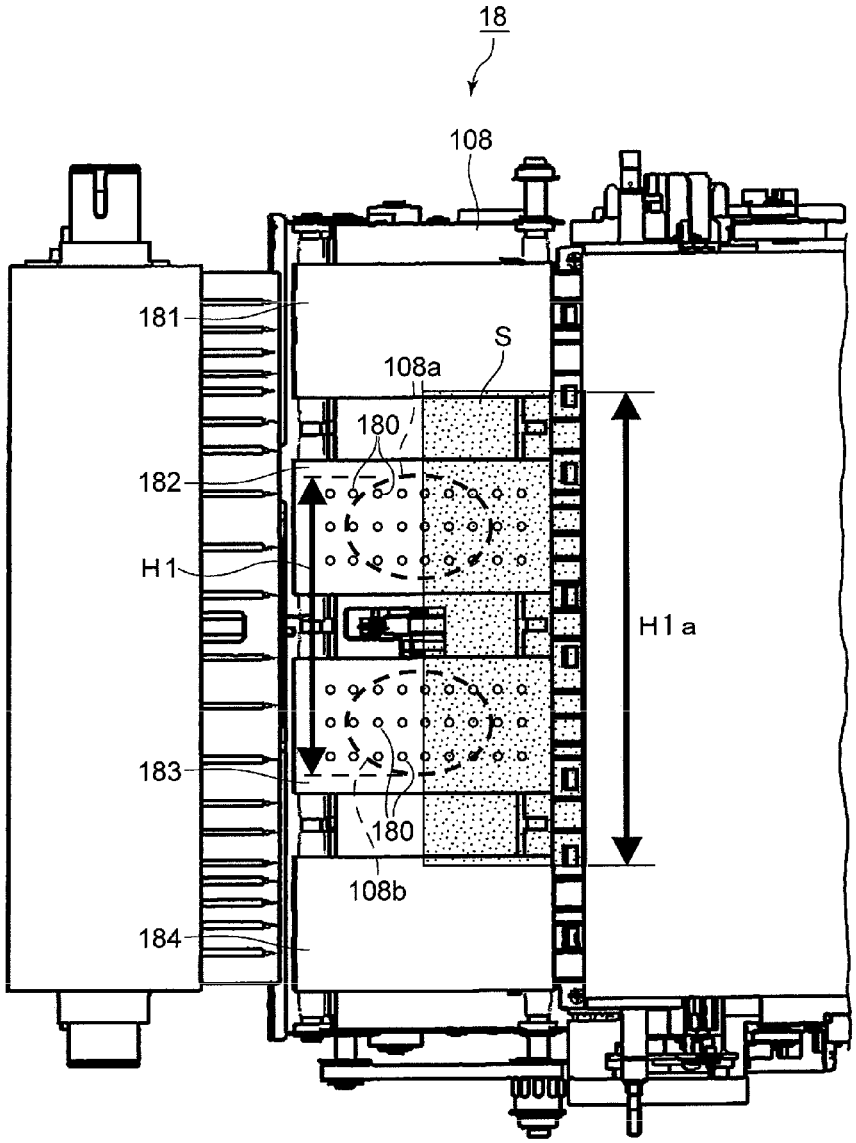
FIG. 6 is a view illustrating the relationship in position between a suctioning port width of a suctioning fan and a minimum sheet width according to the present embodiment.

Here, the relationship in position between the suctioning ports 108*a* and 108*b* will be described referring to FIG. 6. That is, with the convey frame 108, the suctioning ports 108*a* and 108*b* provided in the duct portions 108*c* and 108*d* accommodating the suctioning fan 115 (see FIG. 2) are provided on the inner side of (below) the suctioning endless belts 182 and 183 on the projection plane from the sheet conveying upper surface direction. The suctioning ports 108*a* and 108*b* are arranged such that the size H1 in the width direction orthogonal to the sheet conveying direction is on the inner side of the width direction of the size H1*a* of the minimum sheet which can be conveyed by the sheet conveying apparatus 18. By this means, the sheet conveying apparatus 18 is configured to suction and convey sheets of many sizes from the minimum sheet to the sheets of sizes greater than the size H1*a*.

Here, the cause that paper dust and transfer remaining toner adhere to the suctioning endless belts 182 and 183 and non-suctioning endless belts 181 and 184 will be described.

That is, with recent sheet conveying apparatuses, the conveying velocity of the sheets S is increased to improve productivity, or, when the sheets S are conveyed continuously, the distance between the rear end of a preceding sheet and the front end of a subsequent sheet is shortened as much as possible. However, shortening the distance between the rear end of the preceding sheet and the front end of the subsequent sheet causes a problem in an image forming process, and is difficult to perform.

Also, with the present embodiment, there is a distance between the rear end of the preceding sheet and the front end of the subsequent sheet. Between sheets, paper dust and transfer remaining toner which are flying around and which cannot be suctioned by the suctioning fan 115 and remain adhere to the suctioning endless belts 182 and 183 and non-suctioning endless belts 181 and 184 near the suctioning ports 108*a* and 108*b*.

Then, there is a concern that paper dust and transfer remaining toner adhered to the endless belts 181, 182, 183 and 184 gradually accumulate if sheets are repeatedly conveyed, and adhere to the sheets to be conveyed, thereby deteriorating image quality. In this case, if paper dust and transfer remaining toner adhered to the convey belts are gradually adhere to sheets and are brought out, paper dust and transfer remaining toner do not deteriorate image quality of sheets. However, if a great amount of paper dust and transfer remaining toner gradually adhered to and accumulated in the endless belts 181 to 184 adhere to sheets at one time, paper dust and transfer remaining toner significantly deteriorate image quality of sheets.

Here, the phenomenon that paper dust and transfer remaining toner adhere to sheets will be described. Generally, when sheets are conveyed while contacting the endless belts 181 to 184, although gradually, paper dust and transfer remaining toner on surfaces of these endless belts 181 to 184 adhere to the sheets and are conveyed, so that paper dust and transfer remaining toner on the surfaces of the endless belts 181 to 184 are reduced. In this case, paper dust and transfer remaining toner adhere to sheets little by little and are brought out, and therefore influence images of the sheets little.

However, as described above, there has been a proposal conventionally to make a cleaning member abut on the belt surfaces to clean and remove paper dust and transfer remaining toner from sheet conveying surfaces of conveying belts. According to this proposal, for example, unevenness is formed on endless conveying belt surfaces due to a long term of use, and therefore the surface nature is destroyed.

Particularly, when the cleaning member is made slidably contact suctioning endless belts, the vicinity of inlet holes of the suctioning endless belts is scraped due to great friction with the cleaning member, and paper dust and transfer remaining toner are more likely to accumulate. Further, when the degree of unevenness is greater, the amount of accumulated paper dust and transfer remaining toner increases and the contact area between endless belts and sheets decreases, and therefore the amount of paper dust and transfer remaining toner to adhere to the sheets and be gradually brought out decreases. Further, in the attracting areas where inlet holes are provided, the contact pressure between sheets and belt conveying surfaces is high, and therefore paper dust and transfer remaining toner of sheets are more likely to adhere to the sheets collectively. Therefore, when the cleaning member is made slidably contact these suctioning endless belts 182 and 183, a great amount of paper dust and transfer remaining toner on the surfaces accumulate and cause deterioration in image quality of sheets.

Figure 7:
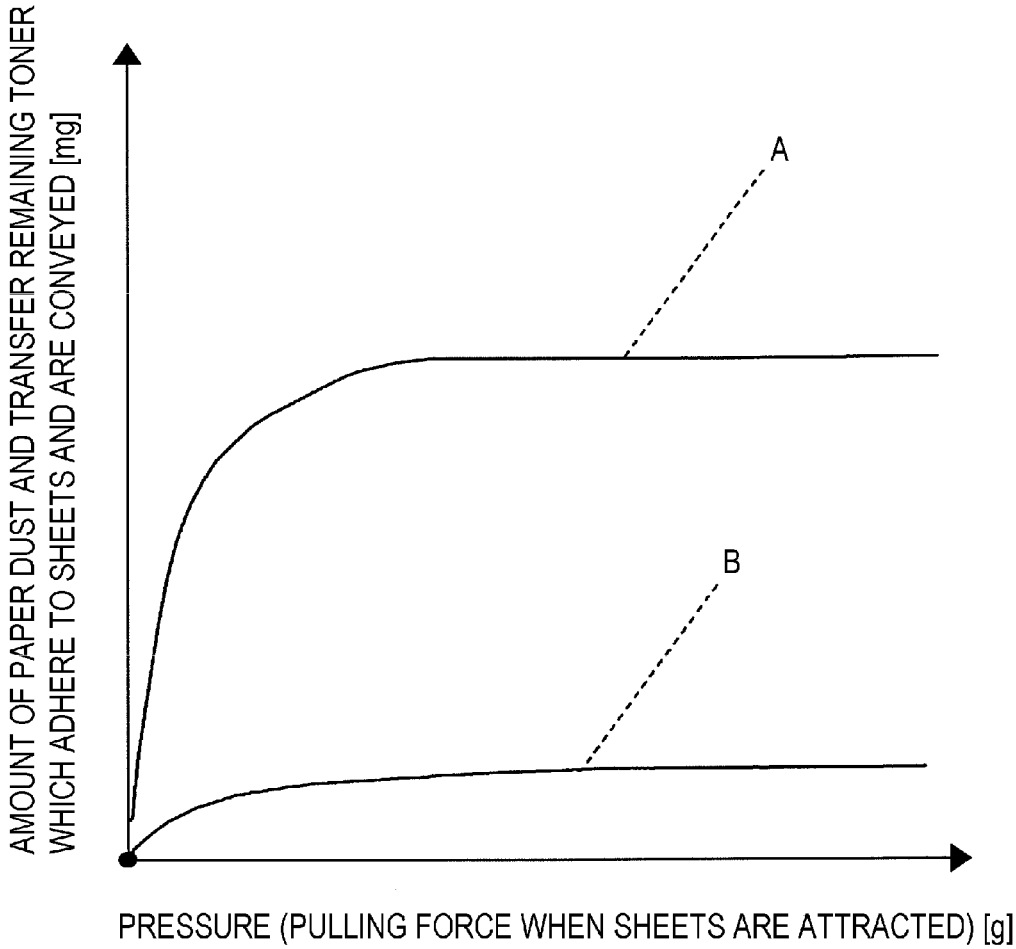
FIG. 7 is a view illustrating the relationship between the amount of paper dust and transfer remaining toner to adhere to a sheet and be conveyed, and pressure.

The present embodiment is proposed to analyze and solve this problem. FIG. 7 is a graph chart illustrating the relationship between paper dust and transfer remaining toner which adhere to sheets and can be brought out and pressure (suctioning force) applied to the sheets by the suctioning fan, when endless conveying belt surfaces are natural surfaces and when endless conveying belt surfaces are coated. Here, the pressure (suctioning force) is evaluated based on the pulling force of pulling sheets when the sheets are attracted and conveyed. In addition, in FIG. 7, symbol A is a graph illustrating a change when conveying belt surfaces are coated, and symbol B is a graph illustrating a change when conveying belt surfaces are natural surfaces.

As illustrated in FIG. 7, both when the conveying belts are coated and when the conveying belts are natural surfaces, the amount of paper dust and transfer remaining toner to adhere to sheets and be conveyed increases by increasing the pressure (suctioning force). That is, by increasing the pressure, it is possible to decrease the amount of paper dust and transfer remaining toner which accumulate in the suctioning endless belts 182 and 183 and non-suctioning endless belts 181 and 184. Further, even by coating the conveying belt surfaces to increase smoothness, it is possible to decrease the amount of paper dust and transfer remaining toner which accumulate in the endless belts 181 to 184.

With this sheet conveying apparatus 18, the amount of paper dust and transfer remaining toner which accumulate in the suctioning endless belts 182 and 183 and non-suctioning endless belts 181 and 184 is great, and therefore coating is applied to these surfaces. By this means, the amount of paper dust and transfer remaining toner which adhere to sheets and are brought out is increased. However, when the conveying belts have natural surfaces, if the amount of paper dust and transfer remaining toner which accumulate in the conveying belts is less than the amount of paper dust and transfer remaining toner which adhere to sheets and can be conveyed, the effect can be expected even by increasing the pressure (suctioning force).

If no cleaning mechanism is provided in an area where there is a concern that image quality is deteriorated because the surface nature of the conveying belts is deteriorated and accumulated paper dust and transfer remaining toner adhere to sheets to be conveyed by slidably contact of the cleaning member, it is possible to improve quality of images to be conveyed.

That is, with the present embodiment, the cleaning brush 200*a* is not made slidably contact the suctioning endless belts 182 and 183 which pass the suctioning ports 108*a* and 108*b*, and the cleaning brush 200*a* is made slidably contact the non-suctioning endless belts 181 and 184 which do not pass the suctioning ports 108*a* and 108*b*. With this configuration, in the attracting areas where the inlet holes 180 are formed in the range of the size H1 in the width direction in FIG. 6, paper dust and transfer remaining toner which adhere to the suctioning endless belts 182 and 183 can be brought to the exterior of the apparatus by the sheets S to be conveyed. By contrast with this, the cleaning brush 200*a* which is the cleaning member can clean and remove paper dust and transfer remaining toner which adhere to the non-suctioning endless belts 181 and 184 which are belt portions outside the attracting areas.

Therefore, in the attracting areas of the suctioning endless belts 182 and 183, roughness of the surface nature due to friction with the cleaning brush 200*a* is not produced, so that it is possible to prevent accumulation of a great amount of paper dust and transfer remaining toner. By contrast with this, although roughness of surface nature is produced in the non-suctioning endless belts 181 and 184 which are belt surfaces (belt portions) of the conveying belts corresponding to the sheet conveying surfaces outside the attracting areas, paper dust and transfer remaining toner can be cleaned by making the cleaning brush 200*a* slidably contact the non-suctioning endless belts 181 and 184. The contact pressure between sheets and belt conveying surfaces due to suctioning does not become high outside the attracting areas, and therefore a great amount of paper dust and transfer remaining toner do not adhere to the sheets. By this means, it is possible to smoothly convey sheets while stably maintaining image quality of sheets.

In addition, it is difficult to bring out all of paper dust and transfer remaining toner which adhere to the suctioning endless belts 182 and 183, and the remaining amount may increase in the long period of use. Therefore, when maintenance of the cleaning brush 200*a* is performed, the suctioning endless belts 182 and 183 may be cleaned.

With the present embodiment, although endless conveying belts which convey sheets on sheet conveying surfaces are configured separately as four of suctioning endless belts 182 and 183 and non-suctioning endless belts 181 and 184, an endless conveying belt may be configured as one endless belt. In this case, in one endless belt, the cleaning brush 200*a* only needs to be configured not to slidably contact the attracting area opposing the suctioning ports 108*a* and 108*b* in the width direction, and slidably contact only the area except this attracting area. When one endless belt is used, a configuration is possible where the inlet holes 180 are formed on the entire surface of the endless belt, in addition to the configuration where the inlet holes 180 are formed only in the attracting area opposing the suctioning ports 108*a* and 108*b* in the width direction.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-042838, filed Feb. 26, 2010, which is hereby incorporated by reference herein in its entirety.

What is claimed is:

1. A sheet conveying apparatus has an attracting and conveying portion which attracts and conveys a sheet, the attracting and conveying portion comprising:

a conveying belt portion which attracts the sheet to a sheet conveying surface by negative air pressure and conveys the sheet in a sheet conveying direction;

a plurality of inlet holes which is provided on the sheet conveying surface of the conveying belt and forms an attracting area which attracts the sheet to the sheet conveying surface by negative air pressure, and the attracting area is set on an inner side of a range in a width direction orthogonal to the sheet conveying direction for a minimum size sheet which can be conveyed by the attracting and conveying portion; and a cleaning member which contacts and cleans the sheet conveying surface of the conveying belt portion, and is arranged outside of the attracting areas in the width direction orthogonal to the sheet conveying direction.

2. The sheet conveying apparatus according to claim 1, further comprising an air suctioning portion which generates negative air pressure by a difference in pressure between the sheet conveying surface and a back surface of the sheet conveying surface.

3. A sheet conveying apparatus having an attracting and conveying portion which attracts and conveys a sheet, the attracting and conveying portion comprising:

a suctioning endless belt which attracts the sheet to a sheet conveying surface thereof by negative air pressure;

a plurality of inlet holes which is formed on the suctioning endless belt;

an air suctioning portion provided on an opposite side of the sheet conveying surface of the suctioning endless belt, which generates negative air pressure to attract the sheet to the sheet conveying surface via the plurality of inlet holes;

a non-suctioning endless belt which is arranged on an outer side of the suctioning endless belt in the width direction orthogonal to the sheet conveying direction; and a cleaning member which contacts and cleans a belt surface of the non-suctioning endless belt.

4. The sheet conveying apparatus according to claim 3, wherein a pair of suctioning endless belts is arranged in parallel in the width direction orthogonal to the sheet conveying direction, and a pair of non-suctioning endless belts is arranged in parallel on an outer side of each of the pair of suctioning endless belts in the width direction orthogonal to the sheet conveying direction.

5. An image forming apparatus comprising a transfer portion which transfers to a sheet a toner image formed as an image by an image forming portion, and an attracting and conveying portion which attracts and conveys the sheet to which the toner image is transferred by the transfer portion, wherein the attracting and conveying apparatus includes:

a conveying belt portion which attracts a sheet to a sheet conveying surface by negative air pressure and conveys the sheet in a sheet conveying direction;

a plurality of inlet holes which is provided on the sheet conveying surface of the conveying belt and forms an attracting area which attracts the sheet to the sheet conveying surface by negative air pressure, and the attracting area is set on an inner side of a range in a width direction orthogonal to the sheet conveying direction for a minimum size sheet which can be conveyed by the attracting and conveying portion; and a cleaning member which contacts and cleans the sheet conveying surface of the conveying belt portion, and is arranged outside of the attracting areas in the width direction orthogonal to the sheet conveying direction.

6. The image forming apparatus according to claim 5, further comprising an air suctioning portion which generates negative air pressure by a difference in pressure between the sheet conveying surface and a back surface of the sheet conveying surface.

7. An image forming apparatus comprising a transfer portion which transfers to a sheet a toner image formed as an image by an image forming portion, and an attracting and conveying portion which attracts and conveys the sheet to which the toner image is transferred by the transfer portion, wherein the attracting and conveying portion includes:

a suctioning endless belt which attracts the sheet to a sheet conveying surface thereof by negative air pressure;

a plurality of inlet holes which is formed on the suctioning endless belt;

an air suctioning portion provided on a side opposite to the sheet conveying surface of the suctioning endless belt, which generates negative air pressure to attract the sheet to the sheet conveying surface via the plurality of inlet holes;

a non-suctioning endless belt which is arranged on an outer side of the suctioning endless belt in the width direction orthogonal to the sheet conveying direction, and a cleaning member which contacts and cleans a belt surface of the non-suctioning endless belt.

8. The image forming apparatus according to claim 7, wherein a pair of suctioning endless belts is arranged in parallel in the width direction orthogonal to the sheet conveying direction, and a pair of non-suctioning endless belts is arranged in parallel on an outer side of each of the pair of suctioning endless belts in the width direction orthogonal to the sheet conveying direction.

9. The sheet conveying apparatus according to claim 3, wherein the suctioning endless belt is set on an inner side of a range in a width direction orthogonal to the sheet conveying direction of a minimum size sheet which can be conveyed by the attracting and conveying portion.

10. The image forming apparatus according to claim 7, wherein the suctioning endless belt is set on an inner side of a range in a width direction orthogonal to the sheet conveying direction of a minimum size sheet which can be conveyed by the attracting and conveying portion.

* * * * *